United States Patent [19]

Inubushi et al.

[11] Patent Number: 4,991,753

[45] Date of Patent: Feb. 12, 1991

[54] DOOR-TYPE ROTARY NOZZLE

[75] Inventors: Hisao Inubushi; Tetsuya Yoshihara; Mioshi Sakamoto, all of Kanagawa, Japan

[73] Assignees: NKK Corporation, Tokyo; Nippon Rotary Nozzle Co., Ltd.; Kokan Kikai Kogyo Kabushiki Kaisha, both of Kawasaki; Tokyo Yogyo Kabushiki Kaisha, Tokyo, all of Japan

[21] Appl. No.: 356,779

[22] Filed: May 24, 1989

[51] Int. Cl.[5] ..... B22D 41/26

[52] U.S. Cl. ..... 222/598

[58] Field of Search ..... 222/598, 512, 548, 599; 266/236

[56] References Cited

U.S. PATENT DOCUMENTS

| | | | |
|---|---|---|---|
| 3,430,644 | 3/1969 | Lyman . | |
| 3,727,805 | 4/1973 | Shapland | 222/590 X |
| 3,912,134 | 10/1975 | Poran | 222/598 X |
| 3,921,866 | 11/1975 | Palazzo | 222/598 X |
| 4,314,659 | 2/1982 | Shapland | 222/598 X |
| 4,480,771 | 11/1984 | Meier | 222/598 |
| 4,498,611 | 2/1985 | Yoshihara . | |
| 4,500,018 | 2/1985 | Zaugg et al. | 222/598 |
| 4,577,785 | 3/1986 | Wakabayashi | 222/598 |
| 4,591,080 | 5/1986 | Yoshihara . | |
| 4,732,304 | 3/1988 | Yoshihara | 222/598 |

FOREIGN PATENT DOCUMENTS

| | | |
|---|---|---|
| 0128841 | 12/1984 | European Pat. Off. . |
| 2457141 | 12/1980 | France . |
| 2522554 | 9/1983 | France . |
| 59-10776 | 6/1984 | Japan . |

*Primary Examiner*—Richard K. Seidel
*Assistant Examiner*—J. Reed Batten, Jr.
*Attorney, Agent, or Firm*—Ladas & Parry

[57] ABSTRACT

A door opening/closing device of door-type rotary nozzle which cannot fit collector nozzle (16) unless clampers are removed. There is no possibility of pouring molten metal while forgetting to remove the clampers (25). When the fixed frame (7) is opened or closed, a ladle is fitted by a 90 degree angle with its bottom almost vertical. So, the fitting and removing operations of the clampers (25) can be performed in front of an operator, which makes the operation very easy.

6 Claims, 3 Drawing Sheets

DOOR-TYPE ROTARY NOZZLE

BACKGROUND OF THE INVENTION

1. Field of the Invention

This invention relates to a door-type rotary nozzle, and more specifically to a door opening/closing device of the door-type rotary nozzle.

2. Description of the Prior Art

Rotary nozzle systems have been used widely with ladles for receiving the molten steel tapped from a converter to transport or pour the molten steel into molds, tundishes for receiving the molten steel from a ladle to pour the molten steel into molds and the like.

Particularly, a door-type rotary nozzle in which a rotor including a slide plate brick are pivoted by hinges so as to open and close these bricks and this type of nozzle has a number of features that the contacting or sliding surfaces of the top nozzle, the bottom plate brick and the slide plate brick can be exposed to permit the confirmation of any damages on the brick surfaces by the naked eye, that there is no need to prepare any standby set for replacing or repairing the bricks, that the operation is easy and so on, has often been used recently.

The door of such a door-type rotary nozzle is pivotably attached with a hinge on a base member fixed to the bottom part of a ladle and opened and closed through this hinge. However, it is necessary to place tightly the bottom plate brick in contact with the slide plate brick at closure to prevent leakage of molten metal and intrusion of air. Also, it is absolutely necessary, for safety, to surely lock it so that it does not open during operation.

One example of such a door-type rotary nozzle is given in the Japanese Laid-Open Patent Application No. 59-107764. To open the door in this door-type rotary nozzle, a clamper is inserted into the portion provided at the upper part of a rotor, and a nozzle hole is set at the fully closed position by rotating the rotor by a 90 degree angle. As a result, a cam intrudes under the clamper and the rotor is pushed down and compresses a coil spring. Therefore, a gap is generated between the bottom plate brick and the slide plate brick, and the door as a whole is pushed down to the part corresponding to this gap. As a result, a lock arm can be easily rotated and unlocked by pushing down a frame on the lock side by hand, and the door can be rotated with the hinge as an axis.

This door-type rotary nozzle has various characteristics and has been widely used in and out of Japan, but the following problems have taken place.

(1) As the clamper is inserted from the side of upper part operators sometimes forget to pull out the clamper to pour in the molten metal, which causes a leakage accident.

(2) As the clamp position is provided on the side of the fixed frame, a holder provided at the ladle interferes in fitting and removing of the clamper.

SUMMARY OF THE INVENTION

The present invention was made to solve the above mentioned problems with the purpose to obtain a door-type rotary nozzle in which fitting and removing of the clamper is easy and removal of the clamper will not be forgotten.

The present invention was made to achieve the above purpose and, in a rotary nozzle comprising a base member in which a bottom plate brick is arranged, a frame which is fitted on the above base member and capable of opening and closing, and a rotor in which gears are provided on its periphery, and a slide plate brick is arranged and which is stored in the above frame through a spring, to provide a door-type rotary nozzle such that cams are provided at the opposing positions on the lower surface of the frame, clamper fitting parts are provided at the lower surface of the rotor, and clampers having engaging parts whose one ends are engaged with the lower surface of the frame can be fitted on and removed from the clamper fitting parts.

When the clampers are fitted on the clamper fitting of the rotor, the engaging parts are engaged with the lower surface of the frame and the rotor is rotated by a 90 degree angle, the cams intrude under the engaging parts, lower the rotor and form a gap between the bottom plate brick and the slide plate brick. If the swing bolt is removed in this state, the frame can be opened like a door.

DESCRIPTION OF A PREFERRED EMBODIMENT

Figure 1:
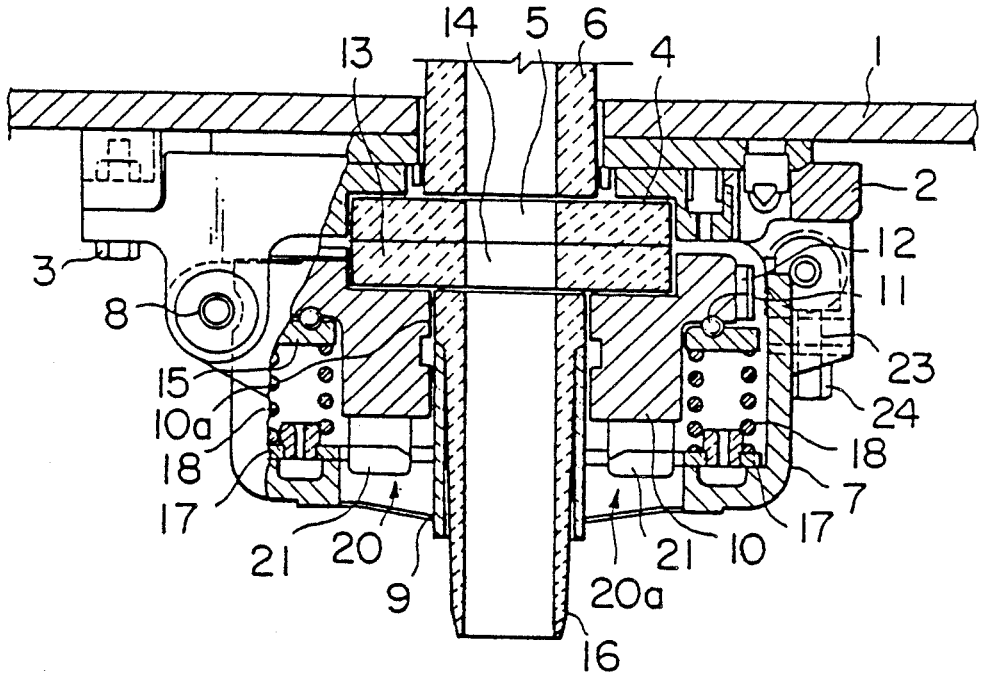
FIG. 1 is a vertical section of a preferred embodiment of the present invention.
Figure 2:
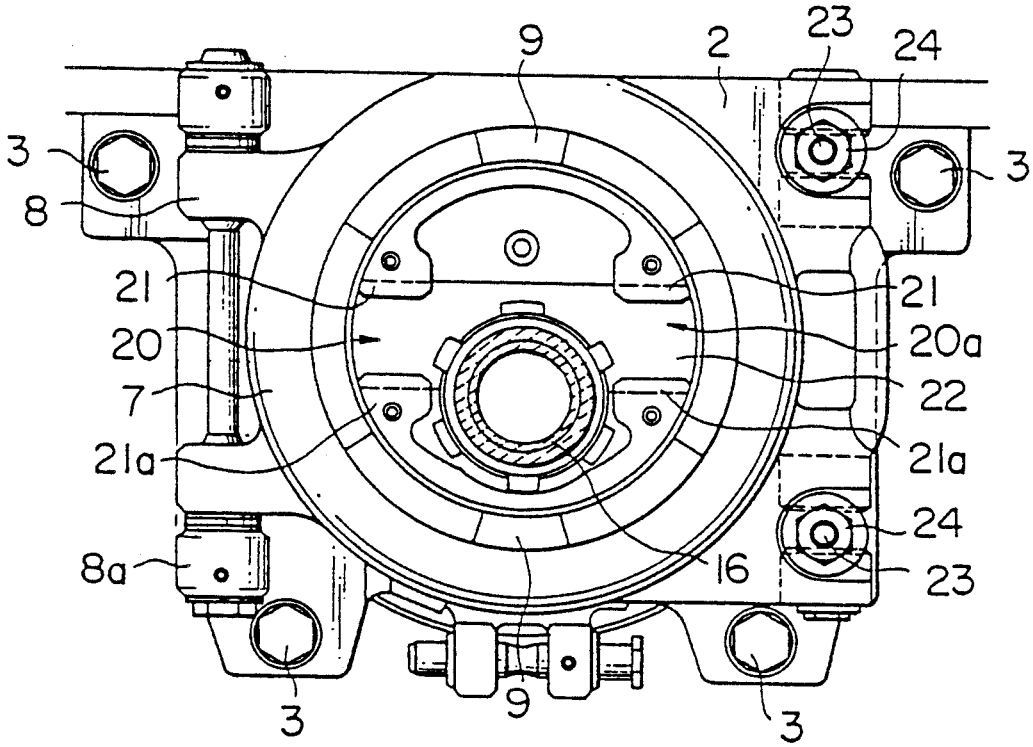
FIG. 2 is its bottom view.

FIG. 1 is a vertical section of a preferred embodiment of the present invention and FIG. 2 is its bottom view. In both the views, (1) is a bottom plate of a ladle tundishes, (2) is a base member fixed on the bottom plate (1) by a bolt (3), on which a bottom plate brick (4) is fitted. (6) is an upper nozzle protruding from a hole penetrating the bottom plate (1) of the ladle and the base member (2), and connected with a nozzle hole (5), (7) is a fixed frame (door) and rotated onto the base member (2) by a hinge (8), and onto the outer circumference of its bottom part. Cams (9) and **(9*a*) are provided on the lower surface of the frame. (10) is a rotor stored in the fixed frame (7) and rotated on a movable frame (15) through a a ball bearing (11), and gears (12) which are engaged with gears (not illustrated) connected with a driving source are provided on its periphery, and a slide plate brick (13) is stored at the upper part. (16) is a collector nozzle to be connected with a nozzle hole (14) of the slide plate brick (13). Incidentally, the installing position of the collector nozzle (16) is provided eccentrically from the center part of the rotor (11). (17) are a plurality of spring washers opposite to the movable frame (15) in the fixed frame (7), and coil springs (18) are interposed between them and the movable frame (15)**, respectively.

Figure 3:
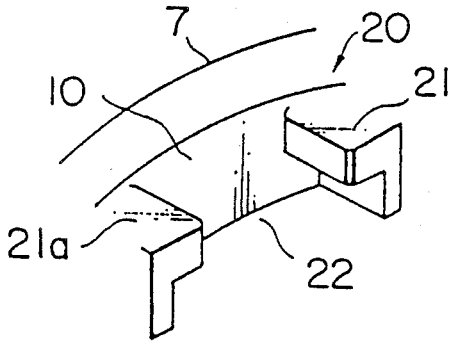
FIG. 3 is a perspective view showing a preferred embodiment of the clamper fitting part.

(20) and **(20*a*) are clamper fitting parts provided at both sides of the lower surface center part of the rotor (10), and as shown in FIG. 3, members (21) and (21*a*) in the shape of an inverted letter L are arranged in the opposed manner with a prescribed interval between them, and a groove (22) is formed by the members (21) and (21*a*). (23) is a swing bolt for fixing the fixed frame (7), and it fixes the frame (7) on the base member (2) with a nut (24) when the fixed frame (7)** is closed.

Figure 4:
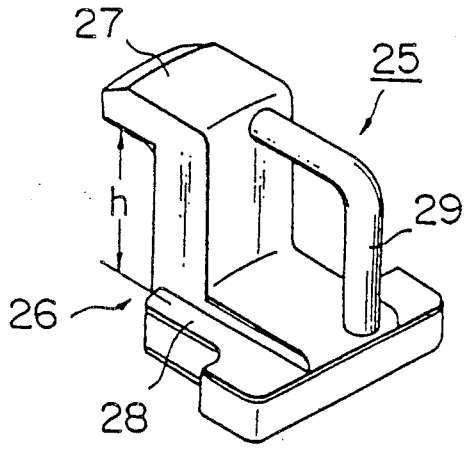
FIG. 4 is a perspective view of a preferred embodiment of the clamper and FIG. 5 to FIG. 7 are explanatory views of action of the present invention.

FIG. 4 is a perspective view showing a preferred embodiment of the clamper. This clamper (25) comprises a body (26) with the side in the approximate shape of the letter Z and a handle (29). The upper part of the body (26) is bent outward in the almost horizontal direction and forms and engaging part (27) to be engaged with the fixed frame (7). The lower part is bent in the opposite direction almost horizontally and forms an inserting part (28) to be fitted to the clamper fitting parts (20) and (20*a*). The height h from the upper surface of the inserting part (28) to the lower surface of the engaging part (27) corresponds to the height from the bottom surface of the rotor (10) to the bottom surface of the fixed frame (7) in the normal state.

In the door-type rotary nozzle above, the collector nozzle (10) is fitted to the rotor (16) when molten metal is poured into it, and the fixed frame (7) is closed and fixed on the base member (2) with the swing bolt (23). So, as shown in FIG. 1, the bottom plate brick (4) is placed tightly in contact with the slide plate brick (13) by coil springs (18) and there is no possibility of leakage of the molten metal. The amount of the molten metal poured is controlled by rotating the rotor (10) by the driving source and adjusting the opening degree of the nozzle holes (5) and (14).

Figure 5:
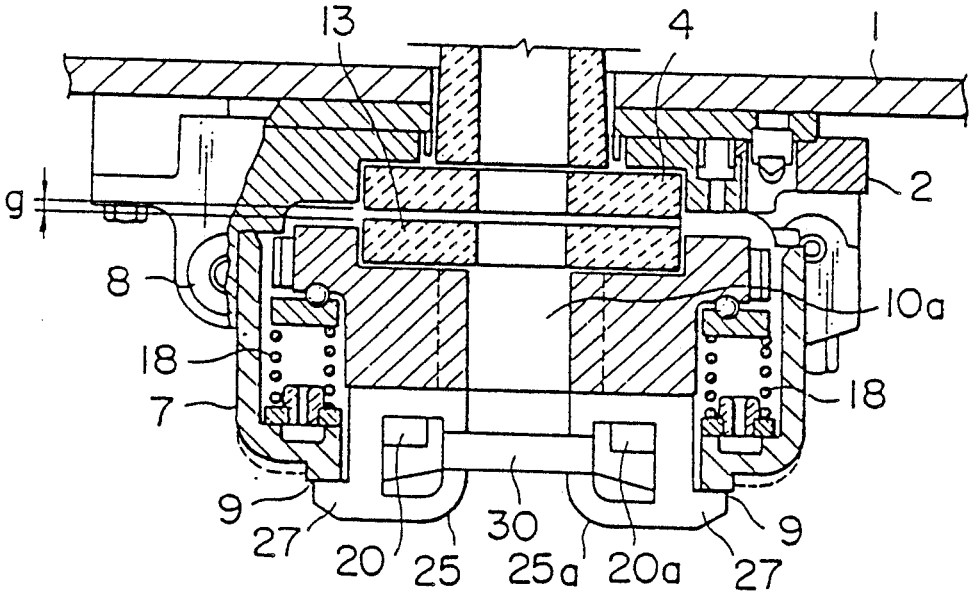
Figure 6:
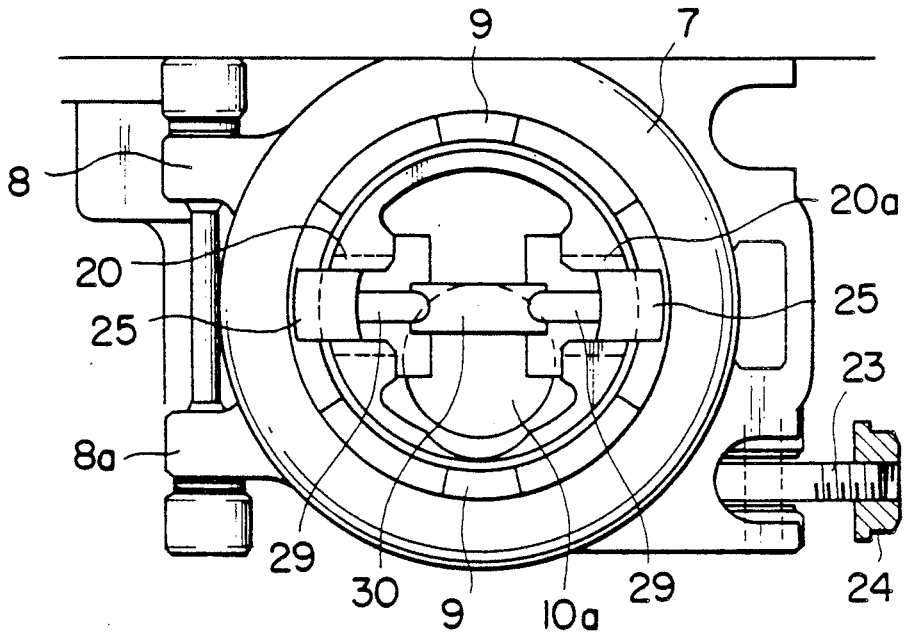

To open the fixed frame (7), the collector nozzle (16) is first removed, as shown in FIG. 5 and FIG. 6. Next, the clampers (25) are fitted on the clamper fitting parts (20) and (20*a*), respectively, their engaging parts (27) are engaged with the bottom part of the fixed frame (7) and a supporting member (30) is fitted between both the handles (29) of both the clampers (25). This supporting member (30) is fitted so that the clampers (25) will not drop when the rotor (10) is rotated. At this time, a part of the fitting hole (10*a*) of the collector nozzle (16) provided at the rotor (10) is closed by the clampers (25) and the supporting member (30).

Figure 7:
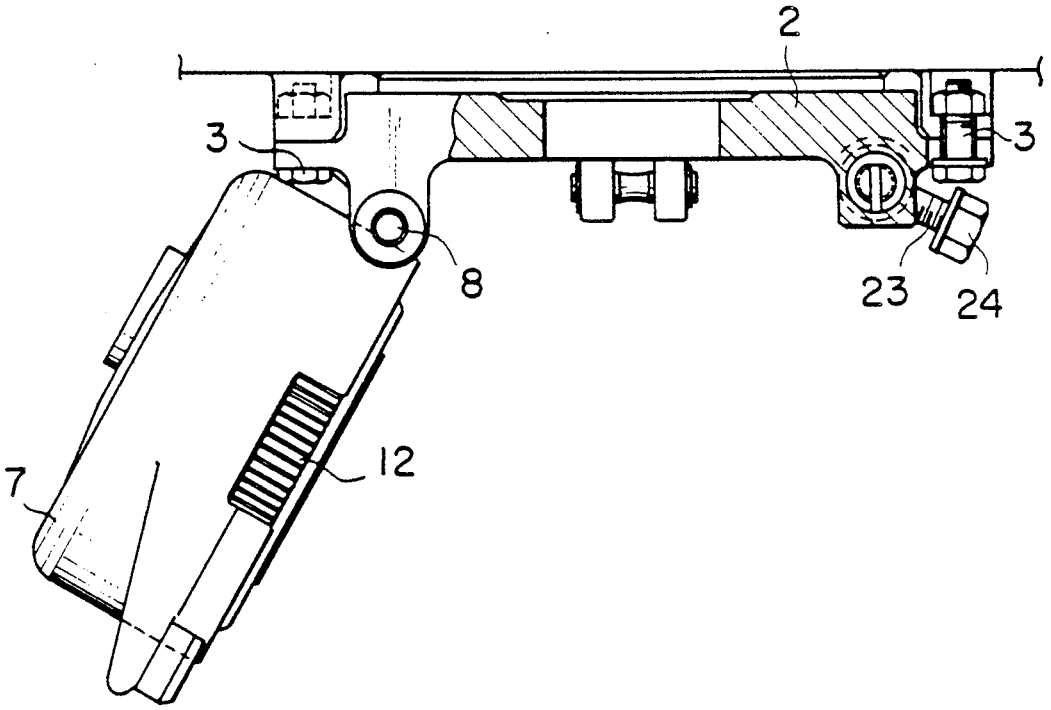

Under the conditions, when the rotor (10) is rotated a 90 degree angle by the driving source, the cams (9) of the fixed frame (7) intrude under the engaging parts (27) of the clampers (25), and the rotor (10) is lowered with compressing the springs (18), and a gap g is generated between the bottom plate brick (4) and the slide plate brick (13). By this, when the lock side of the fixed frame (7) is pushed down by a hand and so forth and the swing bolt (23) is rotated, the lock is released and the fixed frame (7) can be easily opened with the hinge (8) as an axis, as shown in FIG. 7.

In the molding operation, the fixed frame (7) is closed and fixed on the base member (2) by the swing bolts (23), and the clampers (25) are removed to plate tightly the slide plate brick (13) in contact with the fixed plate brick (4). Then, the collector nozzle (16) is fitted in the hole (10*a*) of the rotor (10).

The present invention is embodied in the rotary nozzle of a single door type in the above explanation but it can be also embodied in the rotary nozzle of a double door type.

What is claimed is:

1. A door-type rotary nozzle comprising:

a base member in which a bottom plate brick is arranged, said bottom plate brick having a first nozzle hole defined therein;

a fixed door frame hinged to said base member for swinging said door frame between an open and closed position, said door frame having an opening defined therein;

a rotatable rotor arranged in said door frame and connectable to a drive means, said rotor having a hole defined therein;

a slide plate brick arranged in said door frame, and adjacent an upper portion of said rotor, having a second nozzle hole defined therein, said second nozzle hole and said first nozzle hole being alignable to communicate with one another;

a collector nozzle insertable within said hole in said rotor to communicate with said first and second nozzle holes;

a plurality of spring means positioned between said rotor and an inner portion of said door frame;

at least one clamp fitting part connected to a lower portion of said rotor;

locking means to lock said door frame to said base member in said closed position;

at least one cam surface positioned on an outer surface of said door frame; and at least one clamper, having upper and lower engaging parts, insertable through said opening so that said lower part engages said clamp fitting part and said upper part overlaps said outer surface of said door frame so that rotation of said rotor causes said upper engaging part to contact said cam surface and pull said rotor away from said bottom plate brick and prevents said collector nozzle from being inserted within said hole in said rotor.

2. The door-type rotary nozzle according to claim 1, wherein at least two clamp fitting parts are connected to the lower portion of the rotor to define a groove therebetween.

3. The door-type rotary nozzle according to claim 2, further comprising at least one supporting member that can be wedged between at least two clampers within said groove so that the clampers are pressed against said door frame and prevented from falling through said opening.

4. The door-type rotary nozzle according to claim 3, wherein said clampers have a Z-like shape.

5. The door-type rotary nozzle according to claim 4 further comprising a moveable frame positioned between said rotor and said spring means.

6. The door-type rotary nozzle according to claim 5, wherein at least two cam surface are positioned about said opening.

* * * * *